US007686473B2

(12) United States Patent
Stowell et al.

(10) Patent No.: US 7,686,473 B2
(45) Date of Patent: Mar. 30, 2010

(54) LAMP ASSEMBLY

(75) Inventors: Quinton L. Stowell, Berkshire (GB); Jason Newell, Ealing (GB)

(73) Assignee: Nordson Corporation, Westlake, OH (US)

( * ) Notice: Subject to any disclaimer, the term of this patent is extended or adjusted under 35 U.S.C. 154(b) by 7 days.

(21) Appl. No.: 12/103,003

(22) Filed: Apr. 15, 2008

(65) Prior Publication Data

US 2008/0259595 A1 Oct. 23, 2008

(30) Foreign Application Priority Data

Apr. 19, 2007 (GB) ..... 0707622.7

(51) Int. Cl.
*F21V 19/00* (2006.01)

(52) U.S. Cl. ..... 362/218; 362/640; 362/647; 362/373; 362/217.12; 362/217.16

(58) Field of Classification Search ..... 362/218, 362/373, 640, 647, 217.1–217.17
See application file for complete search history.

(56) References Cited

U.S. PATENT DOCUMENTS

| | | | | |
|---|---|---|---|---|
| 3,819,929 | A | 6/1974 | Newman | |
| 4,000,407 | A | 12/1976 | Keller et al. | |
| 5,049,725 | A * | 9/1991 | Abramson | 392/412 |
| 5,094,010 | A | 3/1992 | Jacobi et al. | |
| 5,321,595 | A | 6/1994 | Jacobi et al. | |
| 5,722,761 | A | 3/1998 | Knight | |
| 5,861,633 | A | 1/1999 | Mandellos | |
| 6,457,846 | B2 | 10/2002 | Cook et al. | |
| 6,619,819 | B2 | 9/2003 | Stowell et al. | |
| 2006/0067072 | A1 * | 3/2006 | Zonta | 362/217 |

FOREIGN PATENT DOCUMENTS

| | | |
|---|---|---|
| EP | 0900977 A2 | 3/1999 |
| FR | 2334966 | 7/1977 |
| GB | 1446167 | 8/1976 |
| GB | 1504291 | 3/1978 |
| GB | 1554253 | 10/1979 |
| GB | 2024393 A | 1/1980 |
| GB | 2284469 A | 6/1995 |
| GB | 2315850 A | 2/1998 |
| GB | 2336895 A | 11/1999 |
| GB | 2349684 A | 11/2000 |
| JP | 58061831 | 4/1983 |

OTHER PUBLICATIONS

UK Patent Office, Search Report in GB Application No. 0707622.7, Aug. 16, 2007, 3 pgs.

* cited by examiner

*Primary Examiner*—Laura Tso
(74) *Attorney, Agent, or Firm*—Wood, Herron & Evans, L.L.P.

(57) ABSTRACT

A lamp assembly includes an elongate source of radiation formed with end pieces and a mount connected to the end pieces for securing the radiation source in an irradiator. The mount is shaped for directing air drawn towards the mount to cause the air to flow around at least part of the radiation source and between the radiation source and the mount.

11 Claims, 3 Drawing Sheets

LAMP ASSEMBLY

The present application claims the priority of British Patent Application No. 0707622.7 filed Apr. 19, 2007 under 35 U.S.C. §119. The disclosure of that priority application is hereby fully incorporated by reference herein.

TECHNICAL FIELD

This invention relates to lamp assemblies, and more particularly to lamp assemblies for use in the printing and coating industry for the fast curing of inks and the like on a large variety of substrate materials.

BACKGROUND

It is well known to cure inks on a substrate by application of ultra-violet radiation from one or more medium-pressure mercury vapor ultra-violet lamps. It is also well known to provide each lamp in an assembly with a reflector which includes a reflective surface partly surrounding the lamp for reflecting radiation therefrom onto the substrate. The reflective surface has a concave profile which is commonly elliptical or parabolic, the lamp being mounted on the symmetrical center line of the profile and adjacent the apex.

The reflector increases the intensity of the radiation received by the curable material. The penetration of the radiation into the material is an important factor in curing and, while penetration varies with different colors and materials, the higher the intensity the better the penetration.

A problem which arises with known arrangements is that part of the radiation is reflected back onto the lamp itself, which reduces the amount of radiation energy available for curing and leads to heating of the lamp which can adversely affect lamp operation and increase the already large amount of heat given off by the assembly, and which may cause warping and distortion of the coating and/or the substrate.

This problem has been recognized in French Patent 2334966 which describes a reflector in the form of two half-shells, each of which is pivotal about a longitudinal axis within the cavity to the sides of the symmetrical center line thereof. The French Patent proposes deforming the top region of the reflector to give it, externally, a generally concave shape across the width of the lamp by bending the top edge of each half-shell down towards the lamp.

The apparatus disclosed in French Patent 2334966 has disadvantages as a result of its basic form in that a complicated system will be necessary to achieve the desired pivoting action and space has to be provided to accommodate the half-shell pivoting which is inconsistent with the current industry desire for smaller curing assemblies. Cooling of the half-shells will be difficult, again because of the need to accommodate the pivoting action. Problems will also arise as a result of the solution proposed in the French patent to the problem of lamp self-heating. The distortion of the reflector towards the lamp will lead to excessive heating of the distorted portion and will make cooling of the adjacent region of the lamp much more difficult.

The efficient and effective cooling of lamp assemblies has been a constant problem which has become even more important as ever increasing lamp powers have been employed to give faster curing such that substrate speeds can be increased. For example, at the date of the French patent, 1975, maximum lamp powers were only in the region of 250 Watts per inch (100 Watts per cm). Lamp powers of 200-400 Watts per inch (80-160 Watts per cm) are now common and lamps of even higher powers, 500-600 Watts per inch (200-240 Watts per cm) are increasingly being used. Furthermore, the advantages of UV curing, including cleanness and quality, have led to a demand for curing systems capable of operating with a wide variety of substrates, including substrates which are very vulnerable to heat damage.

Earlier assemblies were generally cooled by air alone. In the first air-cooled systems, air was extracted from within the reflector through one or more openings provided above the lamp to draw out the heat. In later systems, cooling air was blown into the assembly and onto the lamp, again through openings located adjacent the lamp.

Increasing cooling requirements due to higher lamp powers led to the use of water cooling alone or in conjunction with air cooling. The cooling water is fed through tubes attached to or integrally formed in the reflector.

GB Patent Application 2336895 discloses a UV dryer for drying printing inks and the like provided with a pair of plates between the reflector and the substrate that are cooled with air or water. A heat sink cooled by water is positioned below the substrate. The dryer itself is cooled by air which is guided to flow over the inner and outer surfaces of the reflector into the upper part of the housing in which the reflector is contained. Air which flows over the inner surfaces of the reflector passes through a gap provided at the apex of the reflector and joins air which has passed over the outer surfaces of the reflector.

The UV lamp is mounted on a carriage which is slidable longitudinally off the housing into and out of the housing for lamp replacement purposes. The carriage includes electrical connector components which mate with corresponding connecting components located within the housing when the carriage is slid fully into the housing.

A significant drawback of water cooled systems is the cost of the water cooling equipment. A further drawback is the need to provide a closed water circuit while still allowing access to the lamp assembly to allow replacement of the lamp.

As a result, 80% of commercially available systems are air cooled. As lamp powers increase, ever more efficient and effective air cooling systems are required to keep temperatures within acceptable limits, not only to prevent damage to the substrate, but also to prevent harm to adjacent equipment and to operators.

As discussed above, there is a current industry desire for smaller curing assemblies. In addition there is a desire for curing assemblies which allow easy lamp replacement without the need to remove the lamp assembly from the curing assembly.

SUMMARY

The present invention provides a lamp assembly comprising an elongate source of radiation formed with end pieces and a mount connected to the end pieces for securing the radiation source in an irradiator, the mount shaped for directing air drawn towards the mount to cause the air to flow around at least part of the radiation source and between the radiation source and the mount.

By providing a mount for the radiation source, i.e., a lamp which guides the cooling air flow, it has been found possible to improve the air flow over the lamp and so increase cooling efficiency and, therefore, lamp efficiency as well as prolonging lamp life.

Preferably, the mount defines a channel for extraction of the air. The mount therefore allows for removal of the cooling air from the vicinity of the lamp.

The mount may comprise a pair of spaced elongate plates each having an end portion out of the plane of the plate, the end portions defining a gap between them and the radiation source. The end portions may be either curved or straight end portions with straight being preferred as providing a higher air velocity over the radiation source.

The gap is set to give the most efficient cooling. For a 150 mm arc length, a gap of 2 to 4 mm is currently preferred. The gap may be varied for different lamp powers, different lamp additives and different lamp head orientations. This arrangement has been found to be particularly effective in producing the desired air flow over the lamp.

The assembly may further comprise electrical connections on the end pieces, a cable extending from the electrical connection of one end piece to the other end piece and a tube through which the cable passes. The tube suitably includes end pieces secured to the mount and the mount preferably causes air to flow over the tube to cool the tube and so the cable.

The advantage of this arrangement is that the lamp assembly can be removed from one end of the curing assembly or other irradiator of which it forms part. Therefore, access is not required at both ends and lamp replacement can be quickly and easily carried out. The cooling of the tube in which the cable is contained prevents damage to the cable and so premature lamp failure.

The lamp assembly preferably forms part of an irradiator having a housing, a reflector supported in the housing comprising a cavity in which the radiation source is located, an elongate reflective surface provided on the cavity surface, the elongate reflective surface partly surrounding the radiation source and having an opening for emission of radiation down towards a substrate, a fan for drawing air towards the mount, and at least one support member to which both the reflector and the mount are connected.

The provision of at least one support member to which both the reflector and the mount are connected enables the lamp assembly to be accurately positioned in relation to the reflector following lamp replacement. The lamp is reliably positioned in relation to the reflector for maximum focus.

In another aspect, two spaced support members may be used having apertures for slidably receiving flanges of the mount to support the mount therebetween. The reflector may be formed in two parts and the support members each suspend one part such as to form the cavity.

It is common to form reflectors in two parts. By providing a support member for each part, with the support members receiving the mount therebetween, an efficient and compact design is provided which accurately locates the lamp relative the reflector cavity.

Suitably, the support members comprise extruded sections.

BRIEF DESCRIPTION OF THE DRAWINGS

An illustrative embodiment of the invention will now be further described by way of example with reference to the accompanying drawings in which.

DETAILED DESCRIPTION OF THE ILLUSTRATIVE EMBODIMENTS

Figure 1:
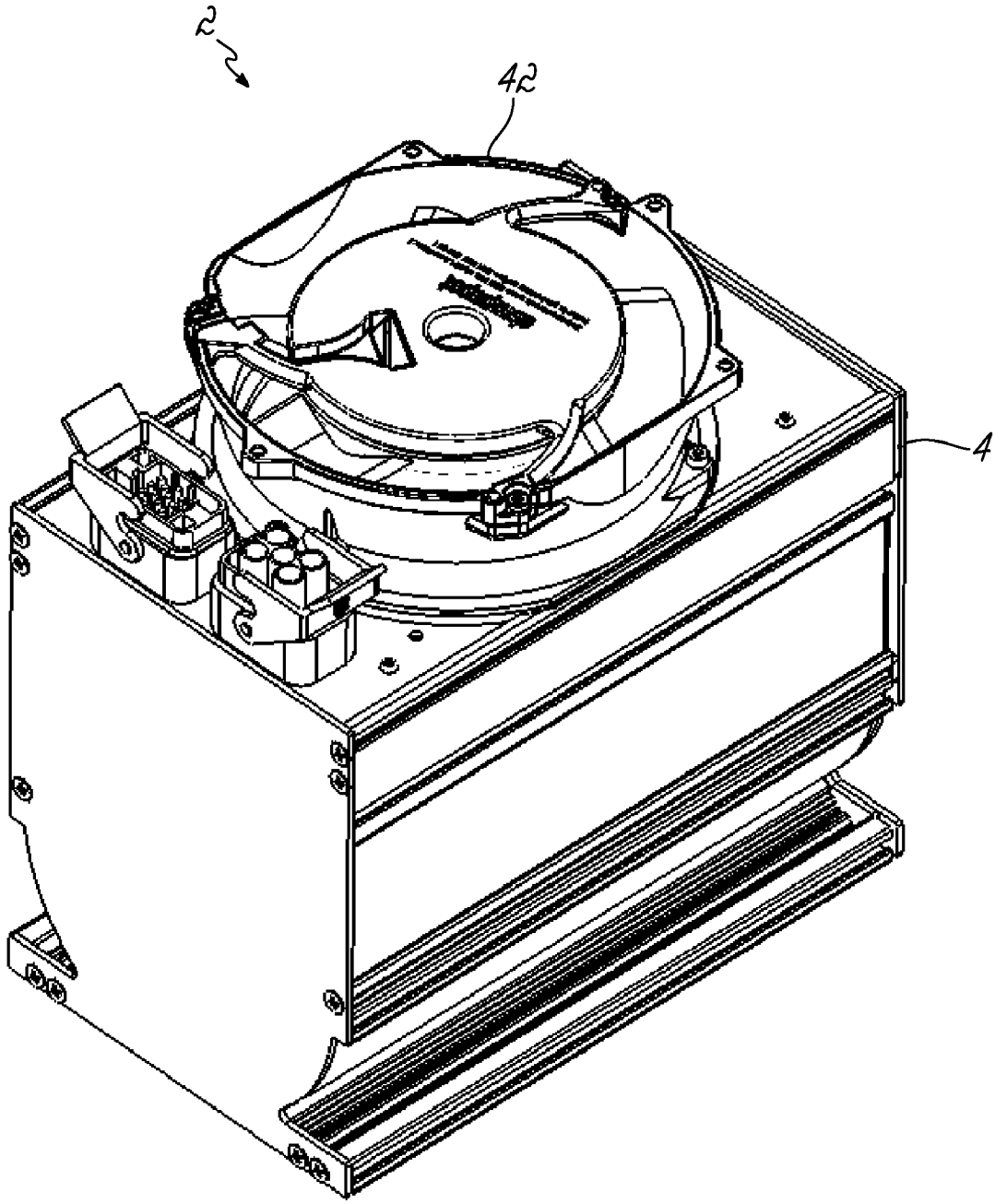
FIG. 1 is a perspective view of an irradiator.

The irradiator 2 comprises a housing 4 in which is mounted a reflector 6.

The reflector 6 comprises two reflector body members 8, 10 each of which is formed as an extrusion. The extrusions 8, 10 each have a shaped surface 12, the shaped surfaces combining to form a cavity 14.

The reflector body members 8,10 are suspended from two extruded sections 16,18 which serve as support members 16, 18 for the reflector 6. The support members 16,18 are in turn suspended from the housing 4.

The reflector 6 serves to reflect radiation emitted from a lamp 20 which is an elongate, tubular, medium-pressure mercury vapor ultra-violet lamp. The lamp 20 has a central portion which emits radiation and end pieces 22 by which it is connected to a power source for energizing the lamp 20.

Figure 3:
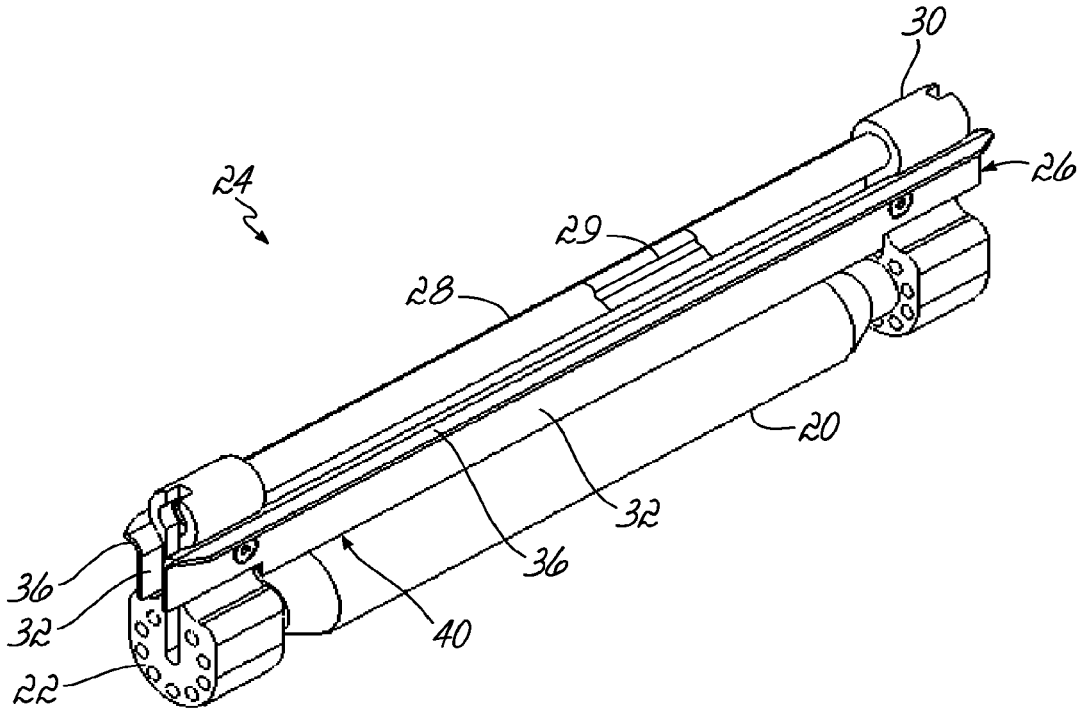
FIG. 3 is a perspective view of a lamp assembly of the irradiator of FIGS. 1 and 2.

The lamp 20 forms part of a lamp assembly 24 shown in FIG. 3. The lamp assembly 24 comprises the lamp 20 with its end pieces 22, a mount 26 and a tube 28 with tube end portions 30 by which the tube 28 is connected to the mount 26.

The tube 28 is dimensioned to receive a cable 29 extending from one end piece 22 of the lamp 20 to the other. The cable 29 allows the power supply to be connected across the lamp 20 from one end of the lamp assembly 24. This means that for replacement of the lamp, access is required at only one end of the housing 4.

Figure 2:
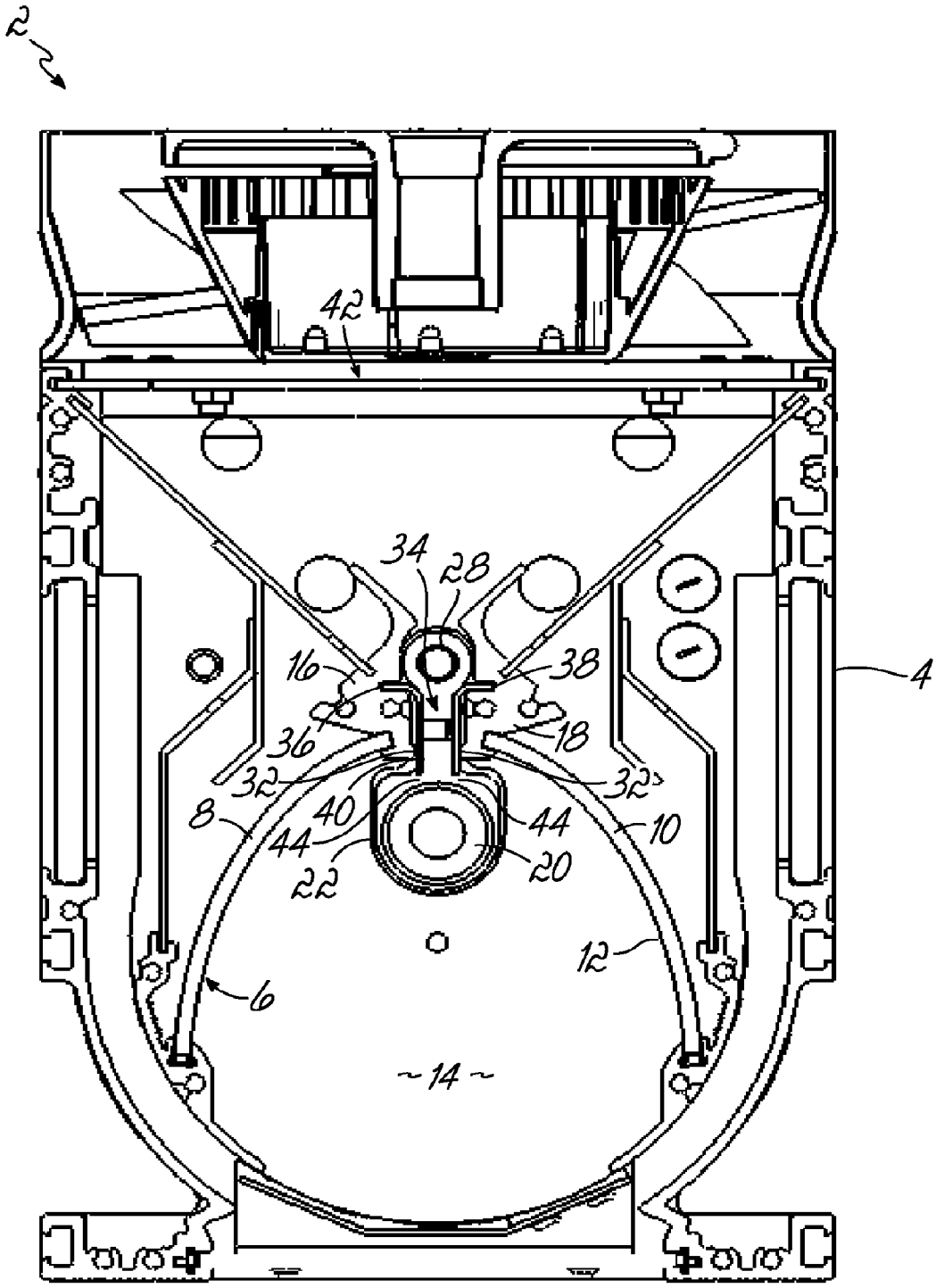
FIG. 2 is a view of the interior of the irradiator of FIG. 1.

The mount 26 comprises two plates 32. The plates 32 are arranged in parallel to define a channel 34 therebetween. At their upper ends, as viewed in FIG. 2, the plates 32 have flanges 36 received in apertures 38 formed in the support members 16, 18. The support members 16, 18 therefore also serve to suspend the lamp assembly 24 in the housing 4 and so to position the lamp 20 in the desired location in the cavity 14.

When the lamp 20 requires replacement, this can be achieved simply by sliding out the lamp assembly 24, replacing the lamp 20, and then sliding the flanges 36 back into the apertures 38 of the support members 16, 18, the new lamp 20 then being reliably positioned in the required location in the cavity 14.

The lower portions 40 of the plates 32 are curved outwardly away from the other plate, the curvature mirroring that of the lamp 20. The lower portions 40 define a gap 44 between the lower portions 40 and the lamp 20.

A fan 42 mounted is on the housing 4 and serves to draw air upwardly over the lamp 20, through the channel 34, over the tube 28 and into the upper portion of the housing 4. The plates 32 and their curved lower portions 40 serve as guides for the air causing it to flow round the lamp 20 between the lamp 20 and the lower curved portions 40 and then up through the channel 34. It has been found that the plates 32 with their lower curved portions 40 are effective in causing cooling of the lamp 20 by the air as it is drawn upwardly by fan 42 which increases lamp efficiency and also lamp life.

As noted, the air is also drawn over the tube 28 and so serves to cool the cable carried in that tube 28. This prevents the cable from overheating and so premature malfunction of the lamp 20.

While the present invention has been illustrated by a description of various embodiments and while these embodiments have been described in some detail, it is not the intention of the Applicant to restrict or in any way limit the scope of the appended claims to such detail. Additional advantages and modifications will readily appear to those skilled in the art. The various features disclosed herein may be used alone or in any combination depending on the needs and preferences of the user. The invention itself should only be defined by the appended claims.

What is claimed is:

1. A lamp assembly for an irradiator, the lamp assembly comprising:

an elongate radiation lamp having first and second end pieces; and a mount including first and second elongate plates, each of said first and second plates including a flange spaced from said lamp and a lower portion proximate to said lamp, each of said lower portions coupled to said first and second end pieces for securing said lamp to said mount, and each of said flanges is adapted to slidably engage the irradiator to remove and replace said lamp from the irradiator.

2. The lamp assembly of claim 1, wherein said mount further comprises a flow channel disposed between said first and second plates.

3. The lamp assembly of claim 2, wherein each of said lower portions of said first and second elongate plates defines a gap between said lamp and said lower portions, said gaps are in fluid communication with said flow channel, and said flow channel and said gaps are adapted to direct cooling air flow in the irradiator over said lamp.

4. An irradiator comprising:

a housing; and a lamp assembly comprising:

an elongate radiation lamp having first and second end pieces; and a mount including first and second elongate plates, each of said first and second plates including a flange spaced from said lamp and a lower portion proximate to said lamp, each of said lower portions coupled to said first and second end pieces for securing said lamp to said mount, and each of said flanges is adapted to operatively engage the housing to remove and replace said lamp from the irradiator.

5. The irradiator of claim 4, further comprising:

at least one support member coupled to said housing, wherein each of said flanges is adapted to slidably engage said at least one support member.

6. The irradiator of claim 5, further comprising:

a reflector mounted on said at least one support member, wherein said mount is adapted to properly locate said lamp with respect to said reflector for maximum reflection of radiation from said lamp when said flanges slidably engage said at least one support member.

7. The irradiator of claim 4, wherein said mount further comprises a flow channel disposed between said first and second plates.

8. The irradiator of claim 7, further comprising:

a fan adapted to generate a cooling air flow in said housing, wherein said flow channel is adapted to direct the cooling air flow in said housing over said lamp.

9. The irradiator of claim 8, wherein each of said lower portions of said first and second elongate plates defines a gap between said lamp and said lower portions, said gaps are in fluid communication with said flow channel, and wherein said flow channel and said gaps are adapted to direct the cooling air flow in said housing over said lamp.

10. An irradiator comprising:

a housing;

a fan adapted to generate a cooling air flow in said housing; and a lamp assembly comprising:

an elongate radiation lamp having first and second end pieces; and a mount including first and second elongate plates, each of said first and second plates including a flange spaced from said lamp and a lower portion proximate to said lamp, each of said lower portions coupled to said first and second end pieces for securing said lamp to said mount, and a flow channel disposed between said first and second plates, said flow channel adapted to direct the cooling air flow in said housing over said lamp.

11. The irradiator of claim 10, wherein each of said lower portions of said first and second elongate plates defines a gap between said lamp and said lower portions, said gaps are in fluid communication with said flow channel, and wherein said flow channel and said gaps are adapted to direct the cooling air flow in said housing over said lamp.

* * * * *